US007143556B2

(12) United States Patent
Hales

(10) Patent No.: US 7,143,556 B2
(45) Date of Patent: Dec. 5, 2006

(54) CAP FOR A FENCE POST

(76) Inventor: Jubie Randell Hales, 361 River Sound Village, Hayesville, NC (US) 28094

( * ) Notice: Subject to any disclaimer, the term of this patent is extended or adjusted under 35 U.S.C. 154(b) by 351 days.

(21) Appl. No.: 10/811,213

(22) Filed: Mar. 26, 2004

(65) Prior Publication Data

US 2005/0210786 A1 Sep. 29, 2005

(51) Int. Cl.
*E04H 12/00* (2006.01)

(52) U.S. Cl. ..... 52/301; 52/300

(58) Field of Classification Search ..... 52/301, 52/300, 302.5, 736.1; 256/1, DIG. 5, 19, 256/66; D25/13 S
See application file for complete search history.

(56) References Cited

U.S. PATENT DOCUMENTS

| | | | | | |
|---|---|---|---|---|---|
| 3,256,659 | A * | 6/1966 | Dudoff | 52/301 |
| 5,148,644 | A * | 9/1992 | Weir | 52/300 |
| 5,419,536 | A | 5/1995 | Bender | 256/1 |
| 5,421,556 | A | 6/1995 | Dodge et al. | 256/1 |
| 5,660,013 | A * | 8/1997 | Saldarelli et al. | 52/301 |
| 5,660,376 | A | 8/1997 | West | 256/22 |
| 5,660,377 | A | 8/1997 | Specht | 256/54 |
| 5,709,057 | A * | 1/1998 | Johnson et al. | 52/301 |
| 5,887,394 | A * | 3/1999 | Workman | 52/301 |
| 5,934,035 | A * | 8/1999 | Rasmussen et al. | 52/300 |
| 6,085,478 | A * | 7/2000 | Workman | 52/301 |
| 6,145,258 | A * | 11/2000 | Barnoff | 52/244 |
| 6,561,499 | B1 | 5/2003 | Lesenskyj et al. | 265/65.01 |
| 6,622,991 | B1 * | 9/2003 | Steffes | 256/1 |
| 6,662,515 | B1 * | 12/2003 | Buhrts et al. | 52/301 |
| 6,722,637 | B1 * | 4/2004 | Burkart et al. | 256/1 |
| 6,994,327 | B1 * | 2/2006 | Steffes | 256/1 |
| 7,021,016 | B1 * | 4/2006 | Steffes et al. | 256/1 |
| 2002/0104985 | A1 | 8/2002 | Lesenskyj | |
| 2003/0106273 | A1 | 6/2003 | Neylon | |

OTHER PUBLICATIONS

Home Tops Decorative Post Caps & Fence Lighting; Jan. 2003 brochure.

* cited by examiner

*Primary Examiner*—Hugh B. Thompson, II
(74) *Attorney, Agent, or Firm*—Harold L. Marquis; George M. Thomas; James W. Kayden

(57) ABSTRACT

A cap for the top end of a fence post with four sides is provided. The cap has two parts, a base which is designed to fit over the end of the post and which has a locking section on each side consisting of a ramp above the top of the side which slopes downwardly to a locking ledge. The base is attached to the top of the post by nails or screws that extend through a hole either in the sidewall of the base or in tabs that project into the aperture in the center of the base. The top member has a locking bar on the inside of each side that snaps over the locking ledge on the base after sliding down the locking ramp. The top member and base are preferable formed from plastic to have sufficient flexibility to allow the locks to lock, but sufficient rigidity to hold them in the locked position.

24 Claims, 5 Drawing Sheets

CAP FOR A FENCE POST

BACKGROUND OF THE INVENTION

1. Field of the Invention

The present invention relates to a cap for putting on the top of a post with four sides, such as a fence post. This cap is of a two piece construction with a base that fits around the top of the post and is attached to the post. The other piece is a top member that is secured by a snap lock to the base after it is attached to the post.

2. Background

The square wooden post has become popular for building fences and for use in supporting decks. The appearance of these posts can be improved by placing a cap on the post which otherwise has a flat top end. A cap of metal or plastic can be nailed or attached by screws to the top of the post, but frequently requires a fair amount of time to secure the cap to each post, which can result in a lot of time for a fence with many posts. It would be desirable to have a cap for posts that was attractive in design and could be secured to the top of a post very quickly. It would also be desirable to have a cap that could be molded of plastic so that it would be inexpensive to produce. It would also be desirable to have a cap for square plastic posts.

Since there a frequently variations in size of tops of wooden posts, it is an object of this invention to develop a cap that would easily accommodate these variations in sizes. It is the further object of this invention to develop a cap that could fit a post of two different sizes without requiring any adjustment to the cap.

SUMMARY OF THE INVENTION

Briefly described, the present invention relates a two piece cap for placing on the top of a fence post, or other kind of post, which has four sides. This cap consists of a base and a top member. The base has four sides and fits over the top end of a post and has means for attaching the base to the post. One of the means for attaching the base to the post is the provision of one or more tabs that extend towards the center of the base and have a hole in the tab which extends over the top end of the post. The tabs are attached to the sides of the base. An elongated fastening member, such as a screw or nail, can be extended through the hole into the wood or composite wood in the top of the post.

The top member of the post cap is secured to the base by a snap lock. As few as two snap locks can be used for securing the top member to the base, but it is preferred to use four sets of snap locks. A locking section comprising a locking ledge located on the outside of the side of the base at the top of the base and a locking ramp above the top of the side which slopes downwardly to the locking ledge is provided. The top member also has four sides with a top extending between the sides. A locking bar is supported on at least two sides of the top. The locking bar is located on the inside of a side and is designed to lock over a locking ledge on the base. This locking bar is snapped in place by pushing the top member down over the base. There must be sufficient flexibility in the base and the top member to allow the locking bar to slide over the ramp and locking ledge of the base and snap into the locked position. On the other hand, there also must be sufficient rigidity in the base and top member to prevent the unlocking of the locking bar under normal conditions. In order to provide a securely locked cap, it is preferable to have a locking section on each side of the cap.

Because the caps of this invention are used on wooden posts where there are variations in the size of the top end of the post, break-away ribs can be placed on the inside of the sides of the base near the bottom to accommodate variations in size of the top end of the post. These ribs will remain intact as a spacing device if the top end of the post is smaller than the aperture in the base which will result in the base being held snuggly onto the post by the ribs. If the top end of the post is only slightly smaller than the dimensions of the aperture in the base, the base can be fitted over the top end of the post which will result in breaking away some or all of the break-away ribs.

For appearance purposes it is often preferred that the top member of the cap be larger than the top end of the post. One way of achieving this is by placing steps in the sides of the base with the steps being arranged so that the sides of the base increase in size from the bottom of the base to the top of the base.

Another means of attaching the base to the post is to provide a hole in at least one side of the base through which a screw or nail can be extended into the side of the post.

The base can be constructed to fit two different sizes of post by providing a stepped corner structure in each corner of the base. In this stepped corner structure, steps are arranged in each corner with a set of steps on all four corners being in the same plane. The aperture formed by the first step in each corner is larger than the aperture formed by the second step so that a post with a larger diameter will fit snuggly against the first step and the post with a smaller diameter will fit snuggly against the second step.

Preferably the base has a number of guides on the top of the base to guide the top member into a locked position. It is also preferable that the locking ramp on the base have two or three ridges that slope downwardly towards the top of the base to facilitate the locking bar of the top member sliding over the locking ledge of the base.

A base is also provided that can be glued to the top of a plastic post or attached by a screw through holes in the side of the base to either a plastic or wood post.

DETAILED DESCRIPTION OF THE PREFERRED EMBODIMENT

Figure 2:
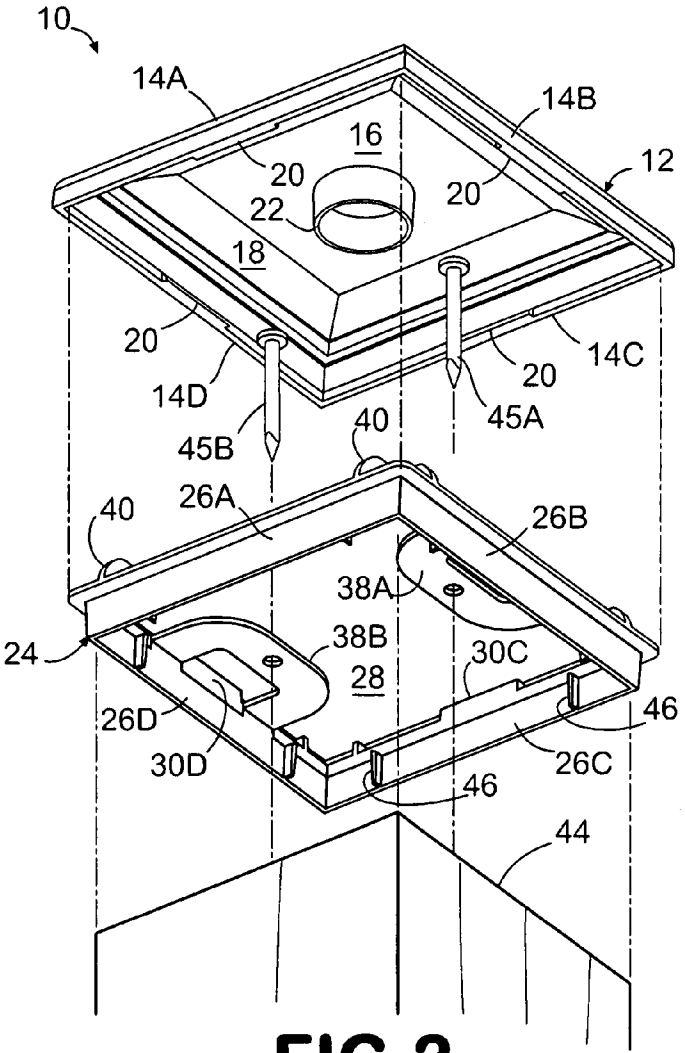
FIG. 2 is a perspective view of the embodiment of FIG. 1 showing the bottom of the top member and the bottom of the base of the cap.
Figure 1:
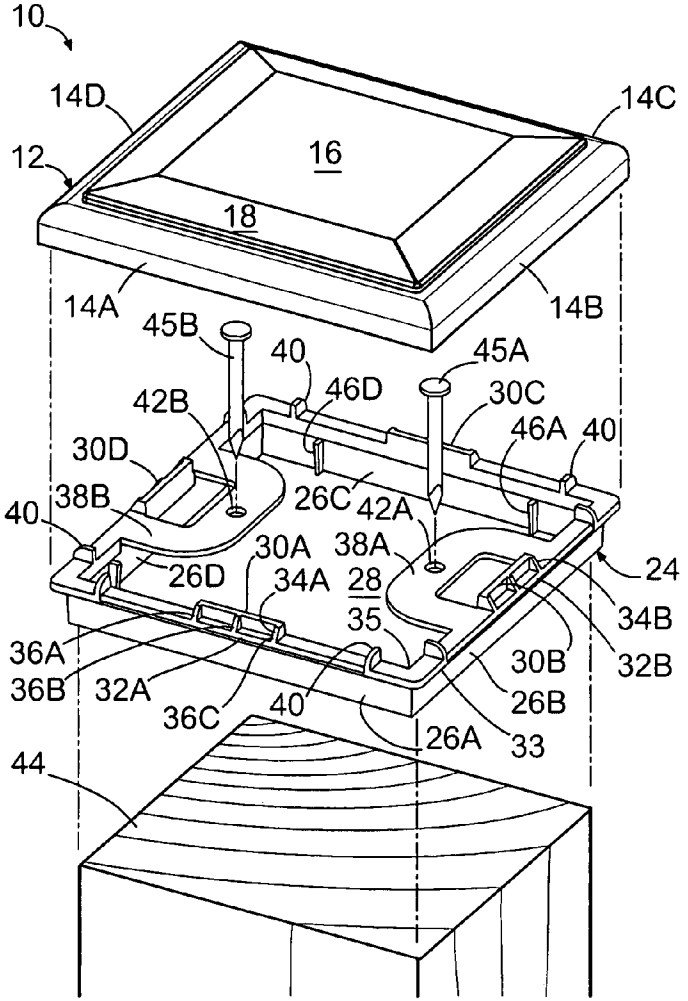
FIG. 1 is a perspective view of one embodiment of the cap of this invention for a fence post or other type of post with a square top.

This invention provides a two piece cap for placing on the top of fence posts, or other types of posts, with four sides. An unassembled fence cap 10 is illustrated in FIGS. 1 and 2. This embodiment of the fence cap has a top member 12 with four sides 14A–D. In this embodiment the middle section 16 of the top member 12 is basically flat, with the perimeter 18 slightly beveled. The top member 12 has a locking bar 20 on each side 14A–D. The locking bar 20 is best illustrated in FIG. 2. The top member 12 has a tubular support 22, whose function will be explained infra.

This fence cap 10 has a base 24 which has four sides 26A–D which correspond with the sides 14A–D of the top member. Sides 26A–D are sized to fit inside sides 14A–D when the top member 12 and the base 24 are assembled. The sides 26A–D define an aperture 28. Each side 26A–D of the base has a locking section 30A–D which consists of two parts, a locking ledge 32A–D and locking ramp 34A–D as shown in FIG. 1 by 32A–B and 34A–B. The locking ledge and locking ramp for locking sections 30C–D are hidden in this perspective. The locking ledges 32A–B shown in FIG. 1 are an integral part of the rim 33 that extends around the perimeter of the base 24. It should be realized that the locking ledges 32A–B can be formed as a separate structure in which case the rim 33 would not need to extend around the base 24. Each locking section 30A–D has a ramp 34A–B as shown in FIG. 1. The ramp 34A–B is located on the top 35 of each side 26A–B of the base 24 as shown in FIG. 1. The ramp 34A is shown with ribs 36A–C that extend downwardly from the top of the ramp 34A. It should be realized that the ramp 34A–B could have a flat surface in place of the ribs 36A–C.

The fence cap 10 is secured to the top of a fence post 44 by first placing the base 24 over the top end of the fence post 44. Because the top ends of wooden fence posts 44 vary in size, break-away ribs 46 may be provided to compensate for the top end of the fence post 44 being slightly larger than the aperture 28 of the base 24 as defined by the break-away ribs 46 which is obviously smaller than the aperture 28 defined by sides 26A–D. Some of the break-away ribs 46 will break away so that the inside of the sides 26A–D of the base fit snuggly against the top end of the post 44. On the other hand, if the top end of the fence post 44 is slightly smaller than the aperture defined by the sides 26A–D, the break-away ribs 46 will remain in place and hold the base 24 snuggly against the top end of the fence post 44. In this case, the break-away ribs act as a spacing device for the top end of the fence post 44.

Two tabs 38A–B are provided for securing the base 24 to the post 44. These tabs 38A–B have two holes 42A–B. The base 24 can be securely attached to the top end of the fence post by driving two nails 45A–B through holes 42A–B in tabs 38A–B. It should be realized that a single tab could be used, but it is preferred that two tabs 38A–B be used. Screws could be used in place of nails 45A–B.

Figure 3A:
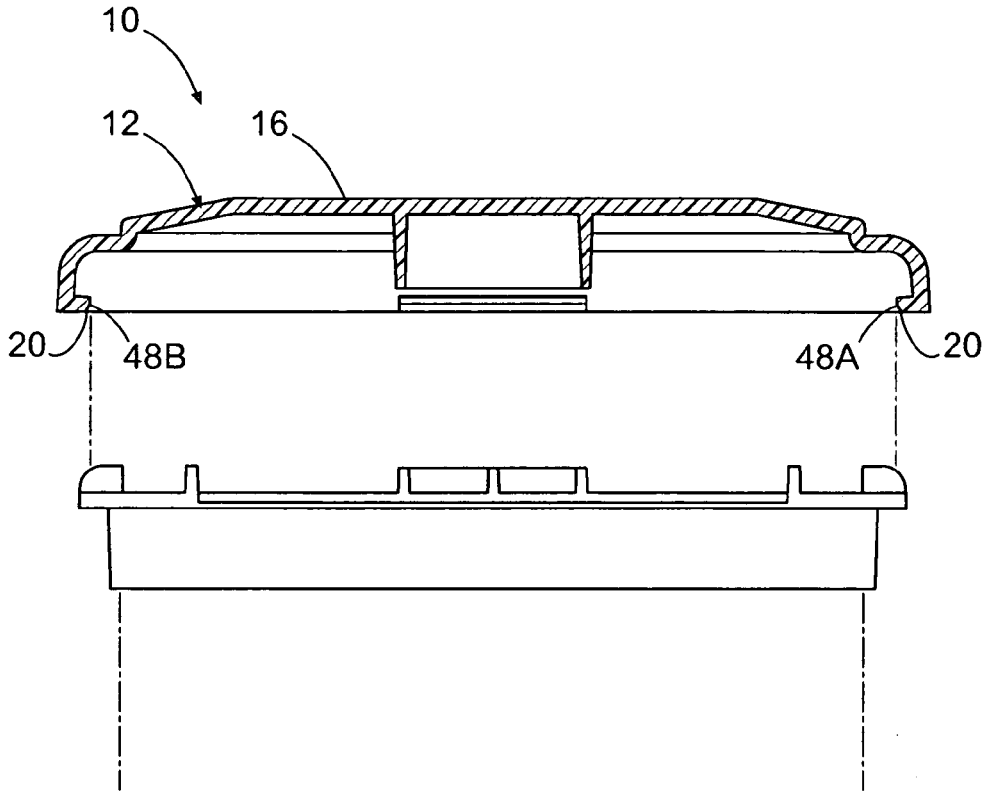
FIG. 3A is a cross-section view of the embodiment of the cap shown in FIG. 1.

Once the base 24 is securely attached to the fence post 44 the top member 12 can be snapped into place. This may be facilitated by the provision of guides 40 on each side 26A–D of the base 24. These guides 40 guide the top member 12 into the locked position. Locking occurs by the locking bars 20 sliding down the ramps 34A–B and snapping into position under the locking ledge 32A–B as shown in FIG. 1. Ribs 36A–C rather than a flat surface on the ramp 34A–B allow the locking bar 20 to be easily moved down the ramp and over the locking ledge 32A–B into the locked position. A lip 48A–B as illustrated in FIG. 3A can be sloped outwardly from the top to the bottom to facilitate the locking bar 20 sliding over the ramp 34A–B. It should be realized that the top member 12 could be locked to the base 24 by providing only two locking sections (e.g. 30A and 30C) on opposite sides of the base 24. However, it is preferred to have a locking section on each side 26A–D of the base 24 so that the top member 12 is securely locked to the base 24.

Figure 3B:
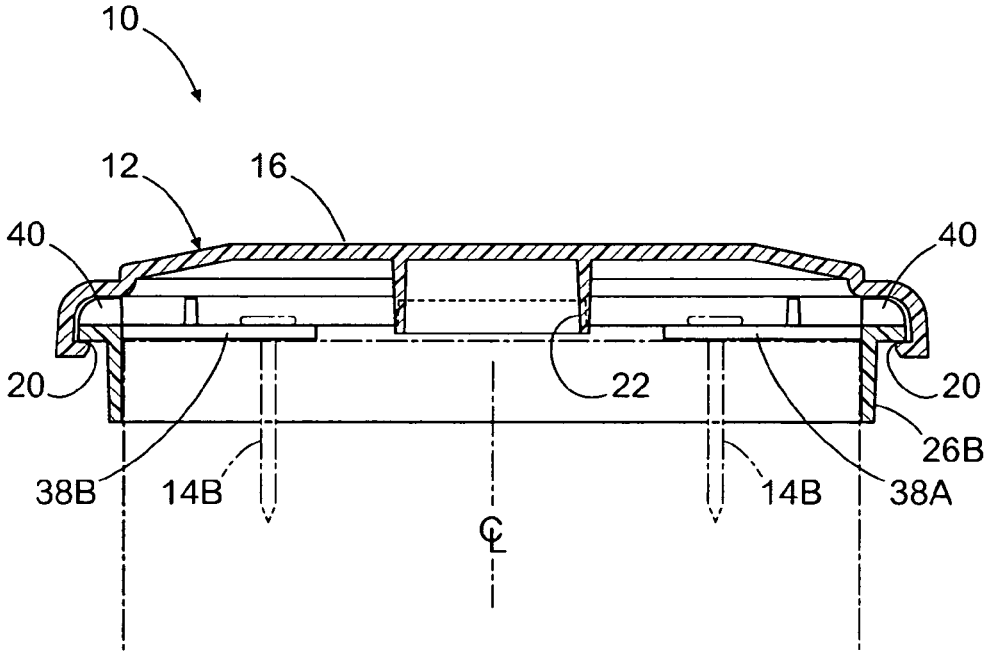
FIG. 3B is a cross-section view of the embodiment of the cap illustrated in FIG. 1 showing the top member locked onto the base.

In this embodiment shown in FIGS. 1–3B a tubular support 22 may be provided to prevent the top member 12 from being crushed when force is applied to the top member 12 as would occur when someone stepped on top of the top member 12. The tubular support 22 rests on top of the fence post 44 as shown in FIG. 3B which is a cross-section view of this embodiment with the top member 12 installed on the base 24. It should be realized that the tubular support 22 is an optional feature and it may be constructed having a different configuration.

The fence cap 10 can be constructed of any suitable material that has a degree of flexibility. It will be realized that it is necessary to have some flexibility in the sides 14A–D of the top member 12 and the sides 26A–D of the base 24 in order for the locking bars 20 to slide over the ramps 34A–B and locking ledge 32A–B. While this can be achieved by a material such as aluminum, it is preferred that the fence cap 10 be made of a molded plastic. It is preferred that the fence cap 10 be molded in two pieces, with one piece being the top member 12 and the other piece being the base 24. A preferred plastic is a acrylonitrile-styrene-acrylate. Pigment can be added to the plastic to produce a fence cap of the desired color. A metal top can be glued to the top member 12. This metal top could be copper or aluminum, for example.

A combination of the locking bar 20 and locking ledge 32A–B holds the top member 12 securely to the base 24. It is necessary that there be sufficient flexibility in the top member 12 and/or the base 24 to allow the locking bar 20 to slide over the ramp 34A–B and into position under the locking ledge 32A–B. It is also necessary that there be sufficient rigidity in the top member 12 and the base 24, especially in the sides 14A–D of the top member 12 and sides 26A–D of the base 24 so that the locking bar 20 is not easily disengaged. A balance needs to be created between the flexibility necessary to lock the locking bar and the rigidity necessary to keep the locking bar 20 in the locked position.

This fence cap 10 is especially designed to be attached to the top of wooden post which come in a number of different sizes, such as 4×4, 4×6, 6×6. It should be realized that this fence cap 10 could be applied to the top of fence post with four sides that have a hollow interior such as plastic fence posts that have four sides. In this case the base 24 could be attached to the post by glue or using screws to attach the sides of the base 24A–D to the post 44.

Figure 4:
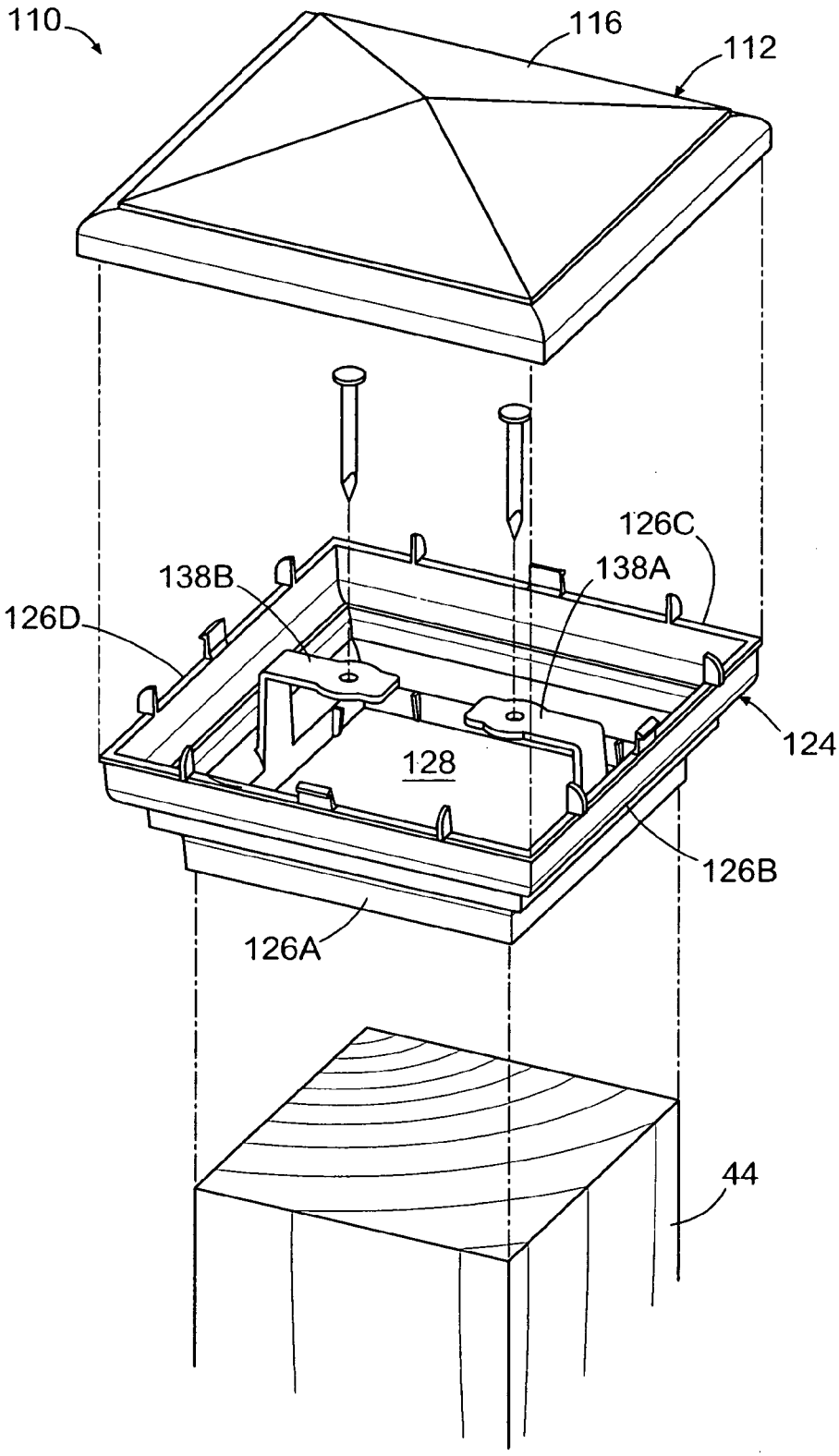
FIG. 4 is a perspective view of a pyramid-shaped cap with a base of another embodiment of this invention in position to be placed on the top end of a post.

FIG. 4 is a prospective view of a fence cap 110 of a different embodiment. The numbers used for FIG. 4 are the same numbers used for FIGS. 1–3B, except where noted below. This top member 112 has a middle section 116 that is shaped like a pyramid. The base 124 has sides 26A–D that have three steps. The first step is 126A which results in the smallest aperture 128. One step up is the step 126B and further up is 126C. The four sides of step 126A are designed to fit snuggly against the top end of the post 44. These steps in this particular embodiment are provided mainly for appearance purposes so that the cap 110 is larger and more aesthetically appealing than the post 44. This base 124 also has two tabs 138A–B that are L shaped in configuration, but are attached to the top of the post 44 in the same way as the tabs 38A–B are in FIGS. 1–3B. The top member 112 of this embodiment is locked to the base 124 in the same way as illustrated in FIGS. 1–3B.

Figure 5:
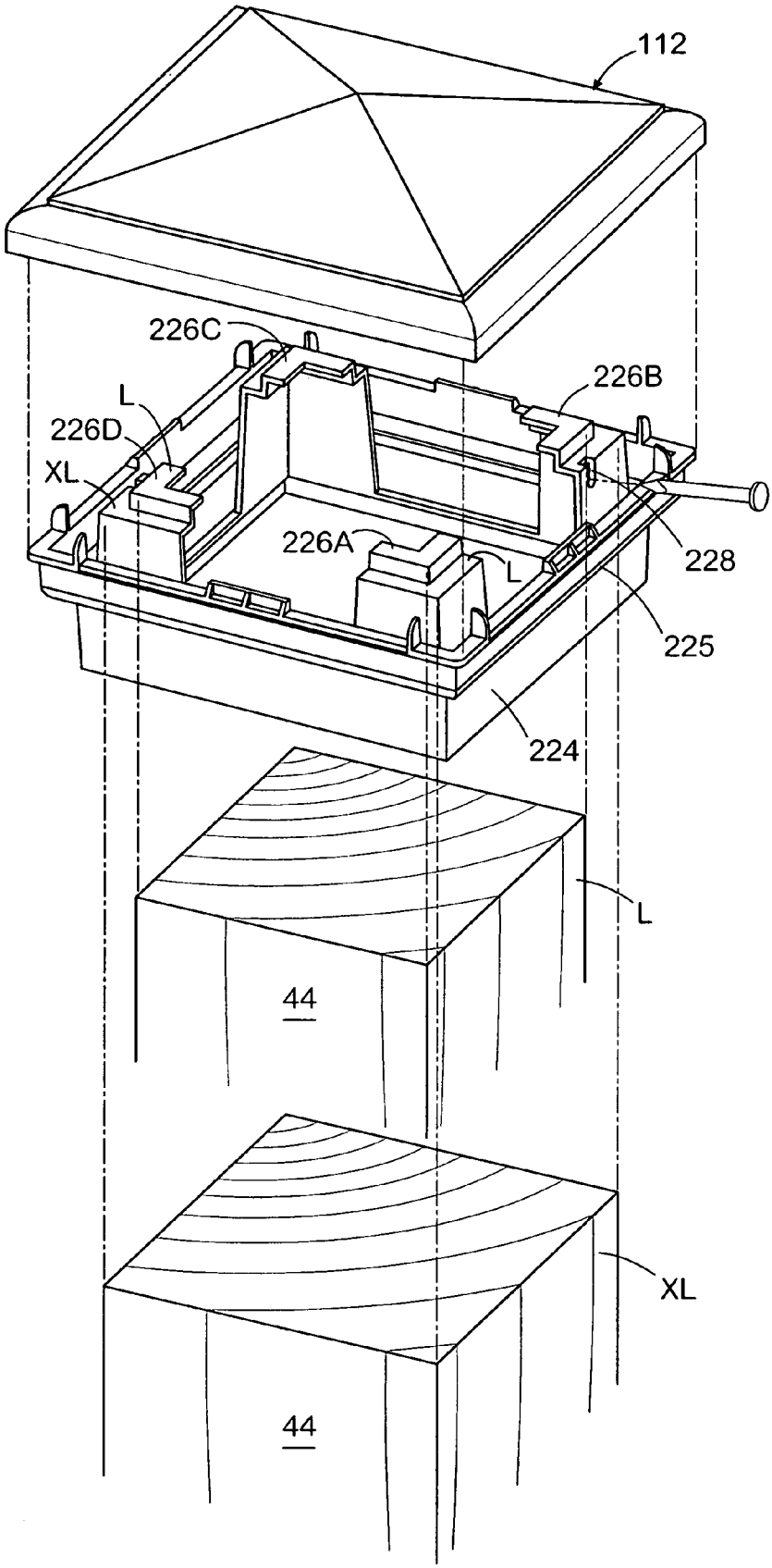
FIG. 5 is a perspective view of the base for a cap of another embodiment of this invention with base being able to fit two different sizes of post.

FIG. 5 shows a base which is able to fit two different sizes of post. Square wooden posts come in many sizes and it would be a cost savings if one size base could fix two different sizes of post. The base 224 shown in FIG. 5 can be used with a top member 112 of the type shown in FIG. 1 or FIG. 4. The numbers used for FIG. 5 are the same numbers used for FIGS. 1–4, except for noted below. This base 224 has steps 226A–D which are designed to fit two different sizes of post L and XL. As shown by steps 226D the large post XL fits snuggly against step XL on all four of the steps 226A–D. A smaller post L can fit against step L on steps 226A–D. One or more holes 228 can be provided in the steps 226A–D for attachment to the post.

The caps of all the embodiments shown in FIGS. 1–5 of this invention not only are aesthetically appealing but also prevent water from entering the top of a wooden post which frequently results in rotting. These caps can also be used with composite wood posts. These caps can be easily installed as it only requires pounding two nails through the holes in the tabs or steps (FIG. 5) in the base and snapping the top member into the locked position.

Figure 6:
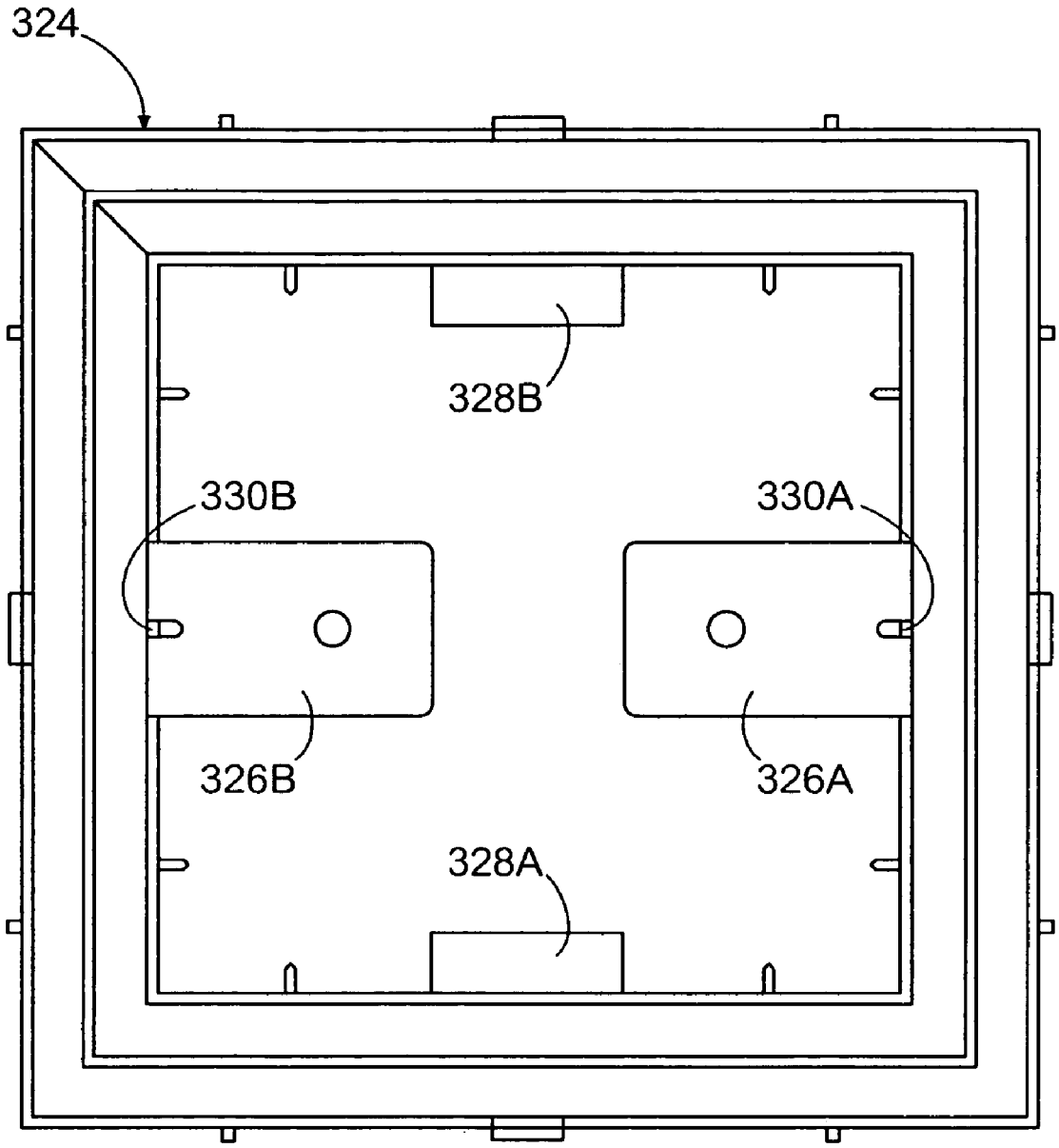
FIG. 6 is the top view of the base for a cap of another embodiment of this invention which is designed to be attached to either a plastic or wood post.

While any of the above embodiments could be adapted to fit a plastic fence post, an embodiment especially designed for plastic fence post is illustrated in FIG. 6. The numbers used for the proceeding figures are the same numbers used for FIG. 6 except where noted below. The base 324 in FIG. 6 can be used with any of the top members described above. This base 324 is designed to either be glued or attached by screws or bolts to the top of a plastic fence post. Two large tabs 326A–B are provided for gluing to the top of a plastic fence post. Smaller tabs 328A–B may be provided for gluing to the top of the fence post. Two apertures 330A–B may be provided for using a screw to attach the base 324 to a plastic fence post. The top member snaps on to the base 324 in the same manner as the other embodiments described above.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

Therefore, having thus described the invention, at least the following is claims:

1. A cap for attachment to an end of a post with four sides, comprising:

(a) a base with a top and bottom and with an aperture defined by four sides, each with an inside and outside, which is designed to fit over the end of a post with each side having a top and bottom, said base having means for attaching to a post with at least two sides of the base supporting a locking section comprising a locking ledge on the outside of the side at the top and a locking ramp above the top of the side which slopes downwardly to the locking ledge;

(b) a top member with four sides with an inside and outside and a top extending between the sides, with at least two sides supporting a locking bar extending into the aperture from the inside of a side for locking over a locking ledge on the base; and (c) there being sufficient flexibility in the base and top member to allow each locking bar to slide over the corresponding ramp and locking ledge of the base, but with sufficient rigidity to secure the top member to the base.

2. The cap of claim 1, in which each side of the base has a locking section and each side of the top member has a locking bar.

3. The cap of claim 2, in which the means for attaching the base to a post comprises at least one tab attached to a side of the base, said tab projecting into the aperture of said base, said tab having a hole for receiving an elongated fastening member that can be extended into a solid material in the end of post to secure the base to the post.

4. The cap of claim 3, in which there are two tabs.

5. The cap of claim 2, which is made of a plastic material.

6. The cap of claim 5, which has sufficient flexibility in each side on the base supporting a locking ledge and each side on the top member supporting a locking bar to enable the locking bars to be snapped into the locked position, but having sufficient rigidity to keep the bars in a locked position under normal conditions.

7. The cap of claim 6, which has a plurality of guides on the top of the base to guide the top member into a locked position with the base.

8. The cap of claim 6, in which each locking ramp on the base has a plurality of ridges sloping downwardly to the locking ledge to facilitate the locking bar of the top member sliding over the locking ledge.

9. The cap of claim 1, in which the means for attaching the base to a post comprises at least one tab attached to a side of the base, said tab projecting into the aperture of said base, said tab having a hole for receiving an elongated fastening member that can be extended into a solid material in the end of post to secure the base to the post.

10. The cap of claim 1, in which the inside of the sides of the base near the bottom of a side has a plurality of break-away ribs which project into the aperture which are designed to insure the base fits snugly to the end of posts of different sizes, said breakaway ribs being designed to break if the end of the post is too large so that the end of the post will fit snugly into said aperture of the base.

11. The cap of claim 1, in which the sides of the base have a plurality of steps with a step on each side being in the same plane as a step on each of the other sides of the base, with the size of the aperture of the base increasing from the steps in the plane closest to the bottom of the base to the top of the base.

12. The cap of claim 11, in which the means for attaching the base to a post is the provision of at least one hole in a side through which an elongated fastening member can be extended into a side of the post to secure the base to a post.

13. The cap of claim 1, in which the top of the top member is pyramid shaped.

14. The cap of claim 1, in which the top of the top member has a middle section and a perimeter with the middle section being at least substantially flat.

15. The cap of claim 14, in which the middle section of the top member has a support that extends into the aperture in the base when the top member and base are locked together to support the top member when the cap is installed on a post.

16. The cap of claim 1, in which the base has four corners, with a corner between adjoining sides, each corner having a stepped corner structure attached to the base, with a plurality of steps in each corner, with a step in each corner being in the same plane as a step in all of the other corners, with the steps in a single plane being capable of receiving the end of a post of a particular size, with the aperture formed by the steps in the same plane near the bottom of the base being larger than the aperture formed by steps in the same plane near the top of the base to accommodate the end of post of different sizes.

17. A plastic cap for attachment to the end of a post with four sides, comprising:

(a) a base with a top and bottom and with an aperture defined by four sides, each with an inside and outside, which is designed to fit over the end of a post with each side having a top and bottom, said base having at least one tab attached to a side of the base, said tab projecting into the aperture of said base, said tab having a hole for receiving an elongated fastening member that can be extended into any solid material in the end of post to secure the base to the post with at least two sides of the base supporting a locking section comprising a locking ledge on the outside of the side at the top and a locking ramp above the top of the side which slopes downwardly to the locking ledge;

(b) a top member with four sides with an inside and outside and a top extending between the sides, with at least two sides supporting a locking bar extending into the aperture from the inside of a side for locking over a locking ledge on the base; and (c) there being sufficient flexibility in the base and top member to allow each locking bar to slide over the corresponding ramp and locking ledge of the base, but with sufficient rigidity to secure the top member to the base.

18. The plastic cap of claim 17, in which each side of the base has a locking section and each side of the top member has a locking bar.

19. The plastic cap of claim 18, in which there are at least two tabs.

20. The plastic cap of claim 18, in which the inside of the sides of the base near the bottom of a side has a plurality of break-away ribs which project into the aperture which are designed to insure the base fits snugly to the end of posts of different sizes, said breakaway ribs being designed to break if the end of the post is too large so that the end of the post will fit snugly into said aperture of the base.

21. The plastic cap of claim 18, in which the top of the top member has a middle section and a perimeter with the middle section being at least substantially flat.

22. The plastic cap of claim 18, in which the top of the top member is pyramid shaped.

23. The plastic cap of claim 18, which has a plurality of guides on the top of the base to guide the top member into a locked position with the base.

24. The plastic cap of claim 18, in which each locking ramp on the base has a plurality of ridges sloping downwardly to the locking ledge to facilitate the locking bar of the top member sliding over the locking ledge.

* * * * *